US007518347B2

(12) United States Patent
Oyama

(10) Patent No.: US 7,518,347 B2
(45) Date of Patent: Apr. 14, 2009

(54) REGULATOR CIRCUIT

(75) Inventor: Kazuhiko Oyama, Miyazaki (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 78 days.

(21) Appl. No.: 11/839,669

(22) Filed: Aug. 16, 2007

(65) Prior Publication Data

US 2008/0067986 A1 Mar. 20, 2008

(30) Foreign Application Priority Data

Sep. 14, 2006 (JP) ..... 2006-249313

(51) Int. Cl.
*G05F 1/40* (2006.01)

(52) U.S. Cl. ..... 323/270; 323/274; 323/303; 323/314

(58) Field of Classification Search ..... 323/312–316, 323/270, 273, 274, 275, 303
See application file for complete search history.

(56) References Cited

U.S. PATENT DOCUMENTS 4,685,046 A * 8/1987 Sanders ..... 363/89
5,555,148 A * 9/1996 Matsuzaki et al. ..... 361/91.7
6,600,297 B2 * 7/2003 Takeda et al. ..... 323/270
6,891,357 B2 * 5/2005 Camara et al. ..... 323/316
2007/0047331 A1 * 3/2007 Lee ..... 365/189.09

FOREIGN PATENT DOCUMENTS

JP 11-121694 4/1999

* cited by examiner

*Primary Examiner*—Jessica Han
(74) *Attorney, Agent, or Firm*—Volentine & Whitt, PLLC

(57) ABSTRACT

A regulator circuit is provided which has a reference voltage outputting unit, a first operational amplifier, a voltage-dividing unit, and a second operational amplifier. The reference voltage outputting unit is connected to a power source voltage, has a rectifying element, and outputs a first reference voltage. The first reference voltage is input to the first operational amplifier, and the first operational amplifier outputs a second reference voltage equal to the first reference voltage. The second reference voltage is input to the voltage-dividing unit, and the voltage-dividing unit outputs a third reference voltage having a voltage lower than the second reference voltage. The third reference voltage is input to the second operational amplifier, and the second operational amplifier outputs an output voltage equal to the third reference voltage.

8 Claims, 6 Drawing Sheets

REGULATOR CIRCUIT

CROSS-REFERENCE TO RELATED APPLICATION

This application claims priority under 35 USC 119 from Japanese Patent Application No. 2006-249313, the disclosure of which is incorporated by reference herein.

BACKGROUND OF THE INVENTION

1. Field of the Invention

The present invention relates to a regulator circuit, and in particular, to a regulator circuit having a function of regulating a temperature gradient.

2. Description of the Related Art

FIG. 9A and FIG. 9B are respectively a circuit diagram showing a conventional regulator circuit 900 and a drawing showing the temperature gradient of the output voltage of the conventional regulator circuit. As shown in FIG. 9A, the conventional regulator circuit 900 is structured from a reference voltage output unit 930 which is connected to a power source voltage 910 and outputs a first reference voltage 921, and an amplifying unit 950 to which the first reference voltage 921 is input and which outputs an output voltage 940.

The reference voltage output unit 930 is formed from a current source 931 which supplies a current value I9, a first variable resistor 932 whose resistance value is set to R91, and a rectifying element 933. VDD potential, which is the power source voltage 910 of the regulator circuit 900, is supplied to the positive terminal of the current source 931. The negative terminal of the current source 931 is connected to the positive terminal of the first variable resistor 932 and to the amplifying unit 950. The positive terminal of the first variable resistor 932 is, as described above, connected to the negative terminal of the current source 931 and to the amplifying unit 950. The negative terminal of the first variable resistor 932 is connected to the positive terminal of the rectifying element 933. Further, the positive terminal of the rectifying element 933 is, as described above, connected to the negative terminal of the first variable resistor 932, and VSS potential which is ground potential is supplied to the negative terminal of the rectifying element 933.

The amplifying unit 950 is formed from an operational amplifier 951, a second variable resistor 952 whose resistance value is set to R92, and a resistor 953 having a resistance value R93. The positive terminal of the operational amplifier 951 is, as described above, connected to the negative terminal of the current source 931 and to the positive terminal of the first variable resistor 932. The negative terminal of the operational amplifier 951 is connected to the negative terminal of the second variable resistor 952 and to the positive terminal of the resistor 953. The output terminal of the operational amplifier 951 is connected to the positive terminal of the second variable resistor 952, and outputs the output voltage 940 to an external circuit. As described above, the positive terminal of the second variable resistor 952 is connected to the output terminal of the operational amplifier 951 and to the external circuit, and the negative terminal of the second variable resistor 952 is connected to the negative terminal of the operational amplifier 951 and to the positive terminal of the resistor 953. The positive terminal of the resistor 953 is, as described above, connected to the negative terminal of the operational amplifier 951 and the negative terminal of the second variable resistor 952. The VSS potential which is the ground potential is supplied to the negative terminal of the resistor 953.

Here, by using FIGS. 9A and 9B, the operation of the conventional regulator circuit 900 will be described by using, as an example, a case in which the regulator circuit 900 outputs the output voltage 940 of 1.0 V at 25° C.

In the example of this case, the rectifying element 933 is a diode, and as the temperature characteristic of this diode, the voltage is in the vicinity of 0.6 V at 25° C. and has a temperature gradient of −2.0 mV/° C., as shown in FIG. 9B.

The first reference voltage 921 becomes a value equal to the sum of the output voltage of the rectifying element 933 and the differential voltage between the current source 931 and the first variable resistor 932 {(first reference voltage)=(voltage of rectifying element)+(voltage of first variable resistor)}.

The temperature gradient of the first reference voltage 921 is a value equal to the sum of the temperature gradient of the first variable resistor 932 and to the negative temperature gradient of the rectifying element 933. Generally, a resistor has a positive temperature gradient because, when the temperature increases, the resistance value of the resistor also increases. The higher the ratio of the voltage of the first variable resistor 932 to the voltage of the rectifying element 933, the more the value of the temperature gradient of the first reference voltage 921, which is output from the reference voltage outputting unit 930, is regulated toward the positive direction. Namely, if the resistance of the first variable resistor 932 is made to be large, the value of the temperature gradient of the first reference voltage 921 can be controlled toward the positive direction. In this example, the first variable resistor 932 is set to be 0.3 V at 25° C., and has a temperature gradient of 0.6 mV/° C. Accordingly, the first reference voltage 921 is 0.9 V at 25° C., and has a temperature gradient of −1.4 mV/° C.

The amplifying unit 950 is a non-inverting amplifier circuit structured from the operational amplifier 951, the second variable resistor 952, and the resistor 953. Because the first reference voltage 921 is 0.9 V, by making it be 10/9 times, the output voltage 940 of 1.0 V is obtained. At this time, the output voltage 940 of 1.0 V is obtained by making the ratio of the resistance values of the second variable resistor 952 and the resistor 953 be 1:9. In this case, because the first reference voltage 921 is amplified 10/9 times, the temperature gradient thereof as well is amplified 10/9 times. Namely, the temperature gradient of the output voltage 940 becomes −1.55 mV/° C.

Further, a regulator which controls the temperature characteristic is disclosed in Japanese Patent Application Laid-Open (JP-A) No. 11-121694. Here, the reference voltage generating circuit is structured from a BGR circuit and an output correcting circuit. The BGR circuit has plural resistors and diodes, and outputs a first voltage as the output voltage from the BGR circuit. The output correcting circuit generates a reference voltage by non-inverting-amplifying the first voltage as a first input voltage. By this reference voltage generating circuit which is structured from the BGR circuit and the output correcting circuit, not only the output voltage, but also the temperature dependency can be minimized.

In a regulator circuit such as shown in FIG. 9A, as described above, if the voltage of the first variable resistor 932 is increased, the temperature gradient of the output voltage 940 can be controlled toward the positive direction. However, in order to output the output voltage 940 of 1.0 V at 25° C., the first reference voltage 921 must be made to be less than or equal to 1.0 V at 25° C. For the first reference voltage 921 to be less than or equal to 1.0 V at 25° C., because the voltage of the rectifying element 933 is 0.6 V at 25° C., the voltage of the first variable resistor 932 must be made to be less than or equal to 0.4 V at 25° C.

Further, with regard to the diode which is the rectifying element 933, because there is little dispersion amongst individual diodes, the diode is used as the reference in designing the reference voltage and the temperature gradient, and therefore, diodes cannot be substituted by another element. Accordingly, because the voltage of the first variable resistor 932 is limited from limitations on the output voltage 940, it is difficult to control the temperature gradient of the output voltage 940 toward the positive direction. Further, a regulator which uses a band gap reference circuit, such as that in aforementioned JP-A No. 11-121694, generally requires current of about several μA, and therefore, it is difficult to reduce the current which is consumed.

Moreover, in a case in which a regulator circuit is used in a driver of an LCD or the like making the temperature gradients of the respective circuits which are used in the LCD or the like small is necessary in order for the screen display to not vary greatly in accordance with the temperature. Further, also in cases in which the temperature gradients of the circuits provided at a panel, a display device or the like and the temperature gradient of the regulator circuit are separated, the difference in the contrast of the display luminance of the screen is marked depending on the temperature. In order to overcome these drawbacks, it is preferable for the temperature gradients of the circuits provided at the panel, the display device or the like, and the temperature gradient of the regulator circuit, to match. Therefore, the temperature gradient of the regulator circuit must be able to be controlled freely at least within the range of −1 mV/° C. to 0 mV/° C., and preferably in the range of −1 mV/° C. to 1 mV/° C. Further, in these technical fields, there is the demand for decreased electric power consumption.

SUMMARY OF THE INVENTION

The present invention has been made in view of the above circumstances and provides According to an aspect of the present invention, there is provided a regulator circuit comprising: a reference voltage outputting unit to which a power source voltage is applied, and which has a rectifying element, and which outputs a first reference voltage; a first operational amplifier to which the first reference voltage is input, and which outputs a second reference voltage having a voltage equal to the first reference voltage; a voltage-dividing unit to which the second reference voltage is input, and which outputs a third reference voltage having a voltage lower than the second reference voltage; and a second operational amplifier to which the third reference voltage is input, and which outputs an output voltage having a voltage equal to the third reference voltage.

BRIEF DESCRIPTION OF THE DRAWINGS

Preferred exemplary embodiments of the present invention will be described in detail based on the following figures wherein.

DETAILED DESCRIPTION OF THE INVENTION

Exemplary embodiments of the present invention will be described hereinafter by using the drawings.

First Exemplary Embodiment

A regulator circuit of a first exemplary embodiment of the present invention will be described by using FIG. 1A and FIG. 1B through FIG. 3.

Figure 1A:
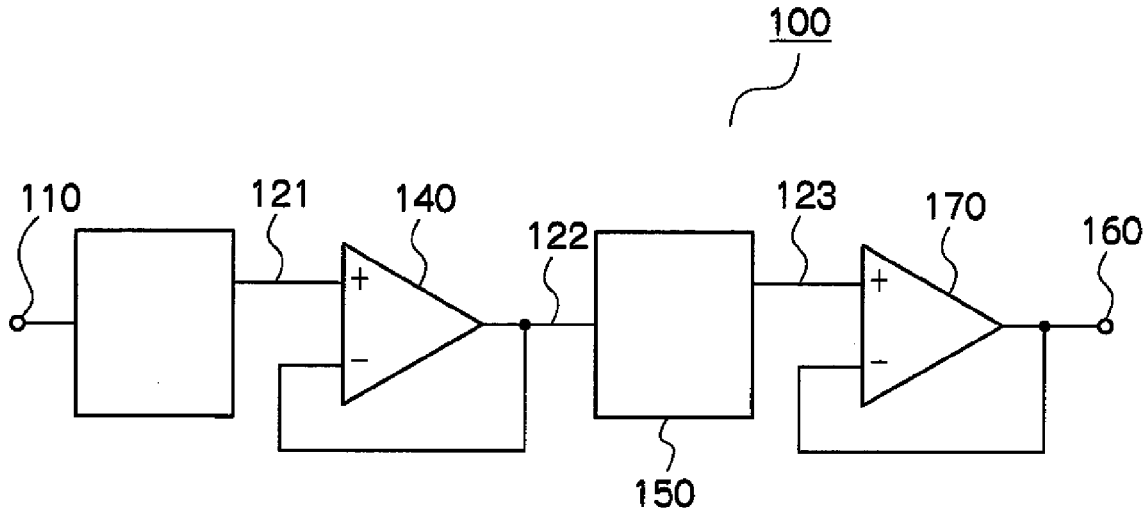
FIG. 1A and FIG. 1B are drawings explaining a regulator circuit of a first exemplary embodiment and temperature gradients thereof.
Figure 1B:
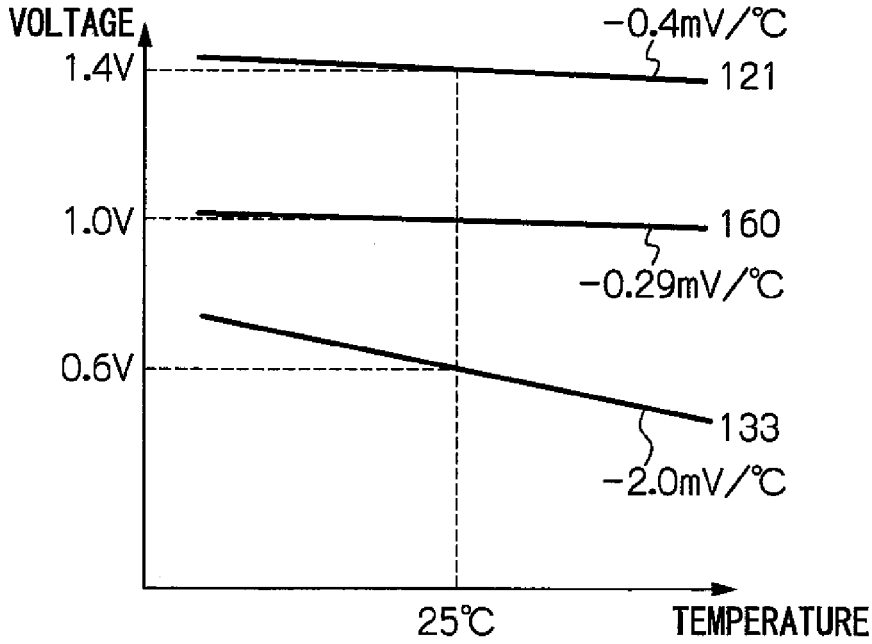

FIG. 1A and FIG. 1B are respectively a circuit diagram showing the regulator circuit of the first exemplary embodiment and a drawing showing the temperature gradient of the output voltage of the regulator circuit of the first exemplary embodiment. As shown in FIG. 1A, a regulator circuit 100 of the first exemplary embodiment is structured from: a reference voltage outputting unit 130 connected to a power source voltage 110, and outputting a first reference voltage 121; a first operational amplifier 140 to which the first reference voltage 121 is input, and which outputs a second reference voltage 122; a voltage-dividing unit 150 to which the second reference voltage 122 is input, and which outputs a third reference voltage 123; and a second operational amplifier 170 to which the third reference voltage 123 is input, and which outputs an output voltage 160.

Figure 2:
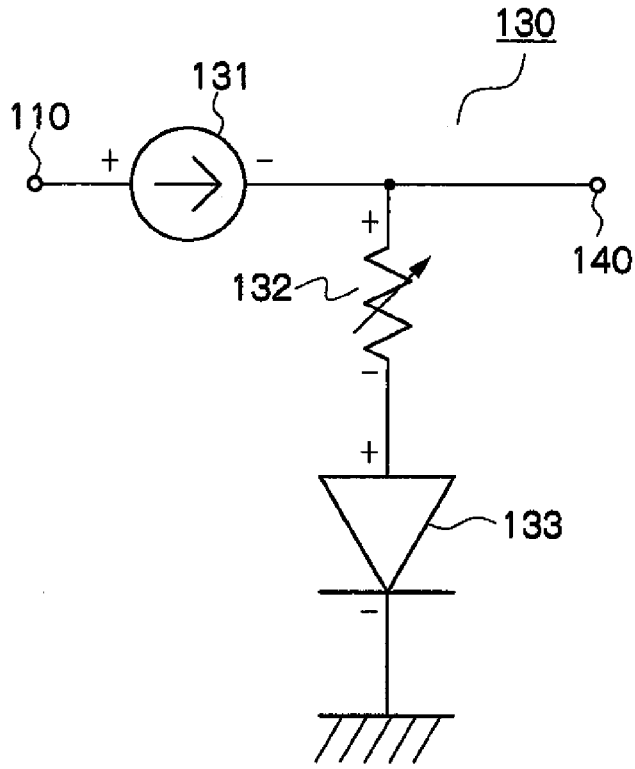
FIG. 2 is a drawing explaining a reference voltage outputting unit of the first exemplary embodiment.

As shown in FIG. 2, the reference voltage outputting unit 130 is formed from a current source 131 which supplies a current value I1, a first variable resistor 132 whose resistance value is set to R11, and a rectifying element 133. VDD potential, which is the power source voltage 110 of the regulator circuit 100, is supplied to the positive terminal of the current source 131. The negative terminal of the current source 131 is connected to the positive terminal of the first variable resistor 132 and to the first operational amplifier 140. The positive terminal of the first variable resistor 132 is, as described above, connected to the negative terminal of the current source 131 and to the first operational amplifier 140. The negative terminal of the first variable resistor 132 is connected to the positive terminal of the rectifying element 133. Further, the positive terminal of the rectifying element 133 is, as described above, connected to the negative terminal of the first variable resistor 132. VSS potential, which is ground potential, is supplied to the negative terminal of the rectifying element 133.

The positive terminal of the first operational amplifier 140 is, as described above, connected to the negative terminal of the current source 131 and to the positive terminal of the first variable resistor 132. The negative terminal of the first operational amplifier 140 is connected to the output terminal of the first operational amplifier 140 and to the voltage-dividing unit 150. The output terminal of the first operational amplifier 140 is, as described above, connected to the negative terminal of the first operational amplifier 140 and to the voltage-dividing unit 150. The first operational amplifier 140 functions as a voltage follower circuit, and outputs the second reference voltage 122, which is a voltage equal to the first reference voltage 121. In this way, the second reference voltage 122 is output without being affected by the impedance or the like of the reference voltage outputting unit 110.

Figure 3:
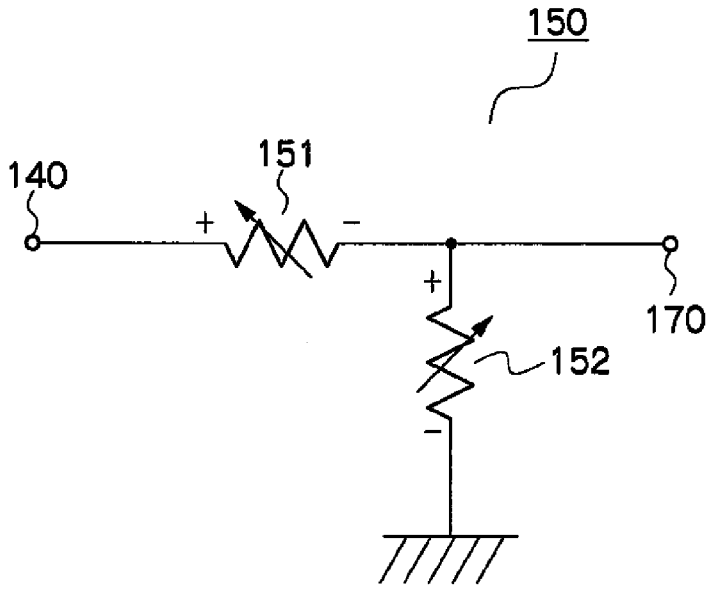
FIG. 3 is a drawing explaining a voltage-dividing unit of the first exemplary embodiment.

As shown in FIG. 3, the voltage-dividing unit 150 is structured from a second variable resistor 151 whose resistance value is set to R12, and a resistor 152 having a resistance value R13. The positive terminal of the second variable resistor 151 is, as described above, connected to the output terminal and the negative terminal of the first operational amplifier 140. The negative terminal of the second variable resistor 151 is connected to the positive terminal of the resistor 152 and to the second operational amplifier 170. The positive terminal of the resistor 152 is, as described above, connected to the negative terminal of the second variable resistor 151 and to the second operational amplifier 170. The VSS potential which is the ground potential is supplied to the negative terminal of the resistor 152.

The positive terminal of the second operational amplifier 170 is, as described above, connected to the negative terminal of the second variable resistor 151 and to the positive terminal of the resistor 152. The negative terminal of the second operational amplifier 170 is connected to the output terminal of the second operational amplifier 170, and outputs the output voltage 160 to an external circuit. The output terminal of the second operational amplifier 170 is, as described above, connected to the negative terminal of the second operational amplifier 170, and outputs the output voltage 160 to the external circuit. The second operational amplifier 170 functions as a voltage follower circuit, and outputs the output voltage 160 which is a voltage equal to the third reference voltage 123. In this way, the output voltage 160 is output without being affected by the impedance due to the circuits at the stages preceding the second operational amplifier 170.

Here, by using FIG. 1A and FIG. 1B through FIG. 3, operation of the regulator circuit 100 of the first exemplary embodiment will be described by using, as an example, a case in which the regulator circuit 100 outputs the output voltage 160 of 1.0 V at 25° C.

In the present exemplary embodiment, the rectifying element 133 is a diode. As the temperature characteristic of this diode, as shown in FIG. 1B, 0.6 V is output at 25° C., and the temperature gradient is −2.0 mV/° C.

As described above, the first reference voltage 121 which is output from the reference voltage outputting unit 110 is a value equal to the sum of the output voltage of the rectifying element 133 and the differential voltage between the current source 131 and the first variable resistor 132 {(first reference voltage)=(voltage of rectifying element)+(voltage of first variable resistor)}. At this time, the temperature gradient of the first reference voltage 121 becomes a value equal to the sum of the temperature gradient of the first variable resistor 132 and the temperature gradient of the rectify element 133 as described above. The first variable resistor 132 is set to become 0.8 V at 25° C., and has a temperature gradient of 1.6 mV/° C. Accordingly, the first reference voltage 121 becomes 1.4 V, and has a temperature gradient of −0.4 mV/° C. The first reference voltage 121, which is 1.4 V and has a temperature gradient of −0.4 mV/° C., is input to the first operational amplifier 140. Because the first operational amplifier 140 functions as a voltage follower circuit, it outputs the second reference voltage 122 which is 1.4 V and has a temperature gradient of −0.4 mV/° C.

The second reference voltage 122, which is 1.4 V and has a temperature gradient of −0.4 mV/° C., is input to the voltage-dividing unit 150, and the voltage-dividing unit 150 outputs the third reference voltage 123 which is 1.0 V. In order to make the third reference voltage 123 be a potential of 1.0 V, the second variable resistor 151 is set such that the ratio of the resistance values of the second variable resistor 151 and the resistor 152 becomes 4:10. At this time, because the third reference voltage 123 is made to be 10/14 times the second reference voltage 122, the temperature gradient of the third reference voltage 123 also becomes −0.29 mV/° C. which is 10/14 times the temperature gradient of the second reference voltage 122.

The third reference voltage 123, which is 1.0 V and whose temperature gradient is −0.29 mV/° C., is input to the second operational amplifier 170. Because the second operational amplifier 170 functions as a voltage flower circuit, the second operational amplifier 170 outputs the output voltage 160 which is 1.0 V and whose temperature gradient is −0.29 mV/° C.

In accordance with the regulator circuit of the first exemplary embodiment of the present invention, by providing the reference voltage outputting circuit 130, the first operational amplifier 140, the voltage-dividing unit 150 and the second operational amplifier 170, even in a case in which a potential which is larger than 1.0 V is supplied to the first reference voltage 121, the potential is lowered by the voltage-dividing unit 150 and the temperature gradient thereof can be reduced. Therefore, the output voltage 160 which is required can be output, and a temperature gradient which is nearer to 0 as compared with a conventional regulator circuit can be obtained. Further, in accordance with the regulator circuit of the first exemplary embodiment of the present invention, the current which is consumed can be suppressed to several hundred nA.

Second Exemplary Embodiment

A regulator circuit of a second exemplary embodiment of the present invention will be described by using FIG. 4A and FIG. 4B through FIG. 8.

Figure 4A:
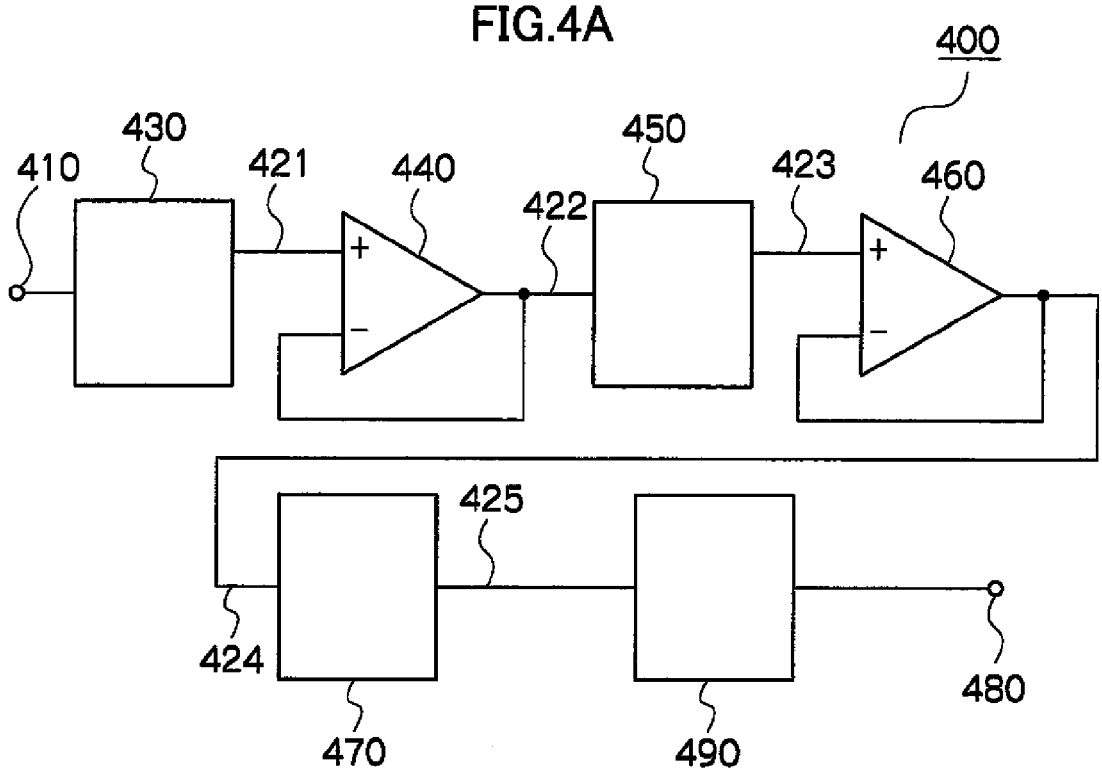
FIG. 4A and FIG. 4B are drawings explaining a regulator circuit of a second exemplary embodiment and temperature gradients thereof.
Figure 4B:
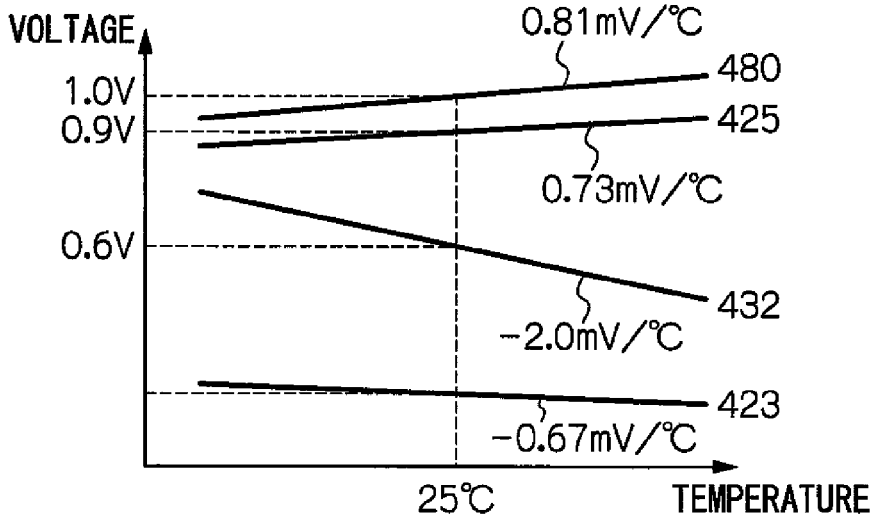

FIG. 4A and FIG. 4B are respectively a circuit diagram showing the regulator circuit of the second exemplary embodiment and a drawing showing the temperature gradient of the output voltage of the regulator circuit of the second exemplary embodiment. As shown in FIG. 4A, a regulator circuit 400 of the second exemplary embodiment is structured from: a first reference voltage outputting unit 430 connected to a power source voltage 410 and outputting a first reference voltage 421; a first operational amplifier 440 to which the first reference voltage 421 is input, and which outputs a second reference voltage 422; a voltage-dividing unit 450 to which the second reference voltage 422 is input, and which outputs a third reference voltage 423; a second operational amplifier 460 to which the third reference voltage 423 is input, and which outputs a fourth reference voltage 424; a second reference voltage outputting unit 470 to which the fourth reference voltage 424 is input, and which outputs a fifth reference voltage 425; and an amplifying unit 490 to which the fifth reference voltage 425 is input, and from which an output voltage 480 is output.

Figure 5:
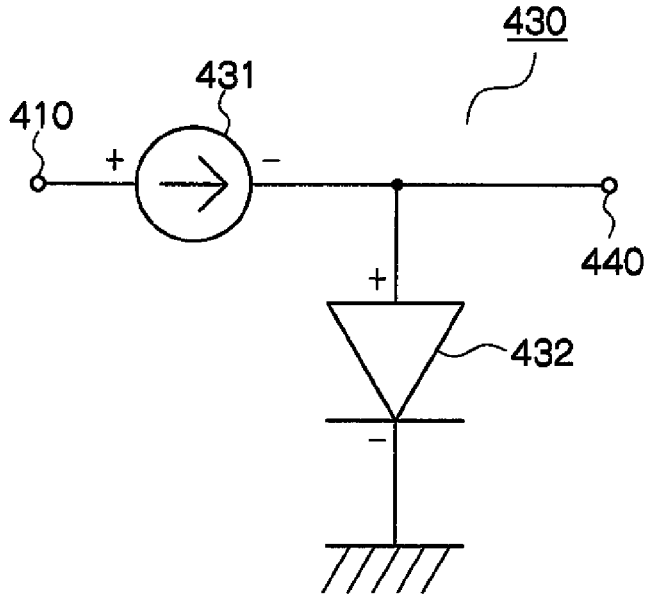
FIG. 5 is a drawing explaining a first reference voltage outputting unit of the second exemplary embodiment.

As shown in FIG. 5, the first reference voltage outputting unit 430 is formed from a first current source 431 which supplies a current value I41, and a rectifying element 432. VDD potential, which is the power source voltage 410 of the regulator circuit, is supplied to the positive terminal of the current source 431. The negative terminal of the current source 431 is connected to the positive terminal of the rectifying element 432 and to the first operational amplifier 440.

The positive terminal of the rectifying element 432 is, as described above, connected to the negative terminal of the first current source 431 and to the first operational amplifier 440. VSS potential, which is ground potential, is supplied to the negative terminal of the rectifying element 432.

The positive terminal of the first operational amplifier 440 is, as described above, connected to the negative terminal of the current source 431 and to the positive terminal of the rectifying element 432. The negative terminal of the first operational amplifier 440 is connected to the output terminal of the first operational amplifier 440 and to the voltage-dividing unit 450. The output terminal of the first operational amplifier 440 is, as described above, connected to the negative terminal of the first operational amplifier 440 and to the voltage-dividing unit 450. The first operational amplifier 440 functions as a voltage follower circuit, and outputs the second reference voltage 422 which is a voltage equal to the first reference voltage 421. In this way, the second reference voltage 422 is output without being affected by the impedance and the like of the first reference voltage outputting unit 410.

Figure 6:
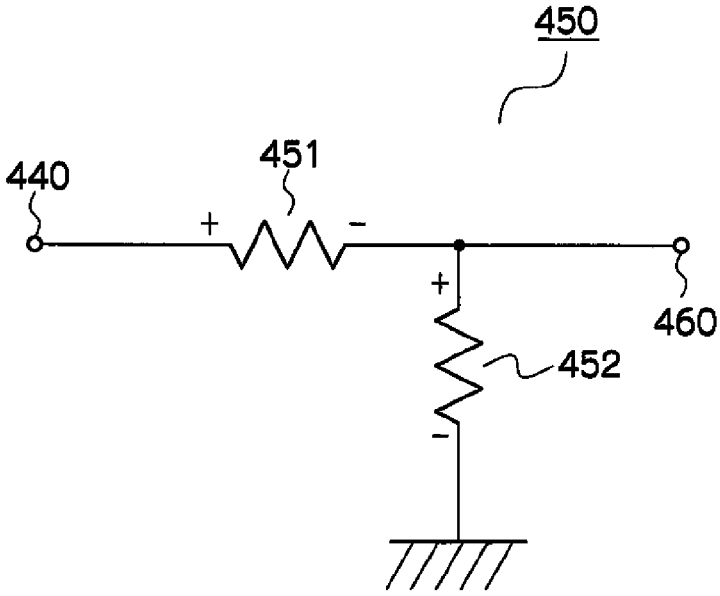
FIG. 6 is a drawing explaining a voltage-dividing unit of the second exemplary embodiment.

As shown in FIG. 6, the voltage-dividing unit 450 is formed from a first resistor 451 having a resistance value R41, and a second resistor 452 having a resistance value R42. The positive terminal of the first resistor 451 is, as described above, connected to the output terminal and the negative terminal of the first operational amplifier 440. The negative terminal of the first resistor 451 is connected to the positive terminal of the second resistor 452 and to the second operational amplifier 460. The positive terminal of the second resistor 452 is, as described above, connected to the negative terminal of the first resistor 451 and to the second operational amplifier 460. The VSS potential which is the ground potential is supplied to the negative terminal of the second resistor 452.

Figure 7:
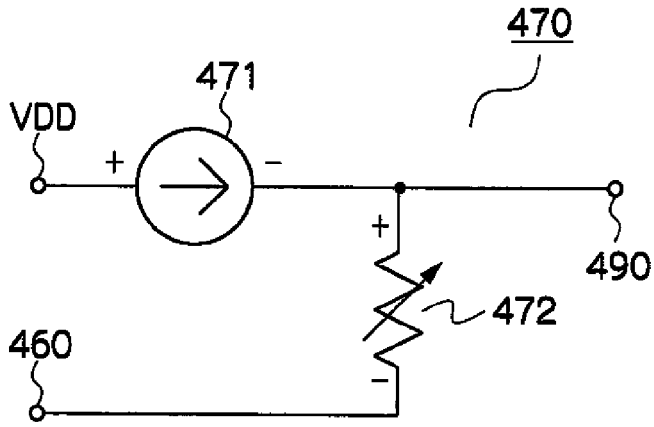
FIG. 7 is a drawing explaining a second reference voltage outputting unit of the second exemplary embodiment.

The positive terminal of the second operational amplifier 460 is, as described above, connected to the negative terminal of the first resistor 451 and to the positive terminal of the second resistor 452. The negative terminal of the second operational amplifier 460 is connected to the output terminal of the second operational amplifier 460 and to the second reference voltage outputting unit 470. The output terminal of the second operational amplifier 460 is, as described above, connected to the negative terminal of the second operational amplifier 460 and to the second reference voltage outputting unit 470. The second operational amplifier 460 functions as a voltage follower circuit, and outputs the fourth reference voltage 424 which is a voltage equal to the third reference voltage 423. In this way, the fourth reference voltage 424 is output without being affected by the impedance due to the circuits at the stages preceding the second operational amplifier 460. As shown in FIG. 7, the second reference voltage outputting unit 470 is formed from a second current source 471 which supplies current value I42, and a first variable resistor 472 whose resistance value is set to R43. The VDD potential, which is the power source voltage of the regulator circuit 400, is supplied to the positive terminal of the second current source 471. The negative terminal of the second current source 471 is connected to the positive terminal of the first variable resistor 472 and to the amplifying unit 490. The positive terminal of the first variable resistor 472 is, as described above, connected to the negative terminal of the second current source 471 and to the amplifying unit 490. The negative terminal of the first variable resistor 472 is, as described above, connected to the output terminal and the negative terminal of the second operational amplifier 460.

Figure 8:
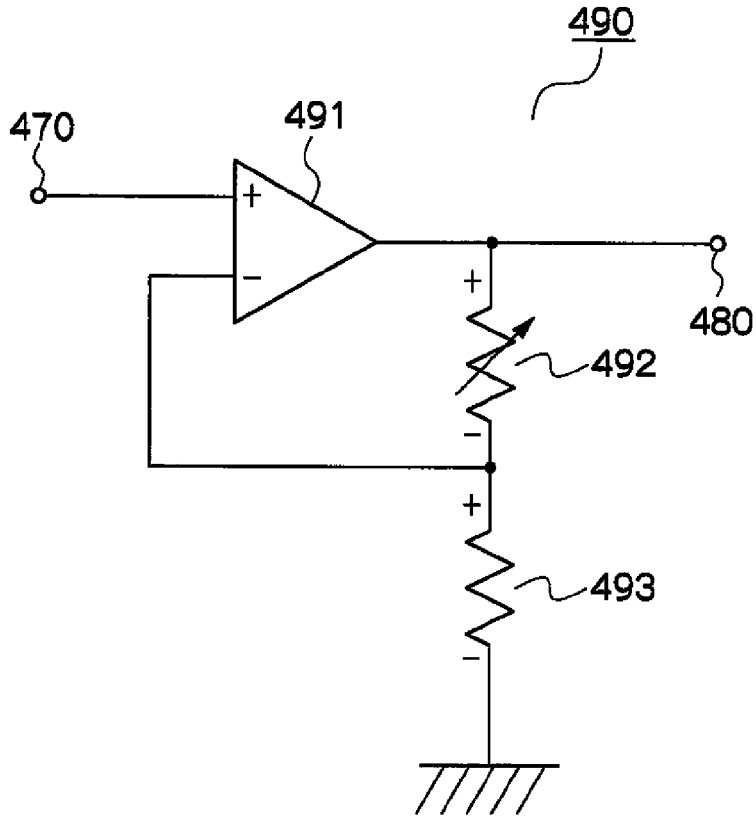
FIG. 8 is a drawing explaining an amplifying unit of the second exemplary embodiment.
Figure 9A:
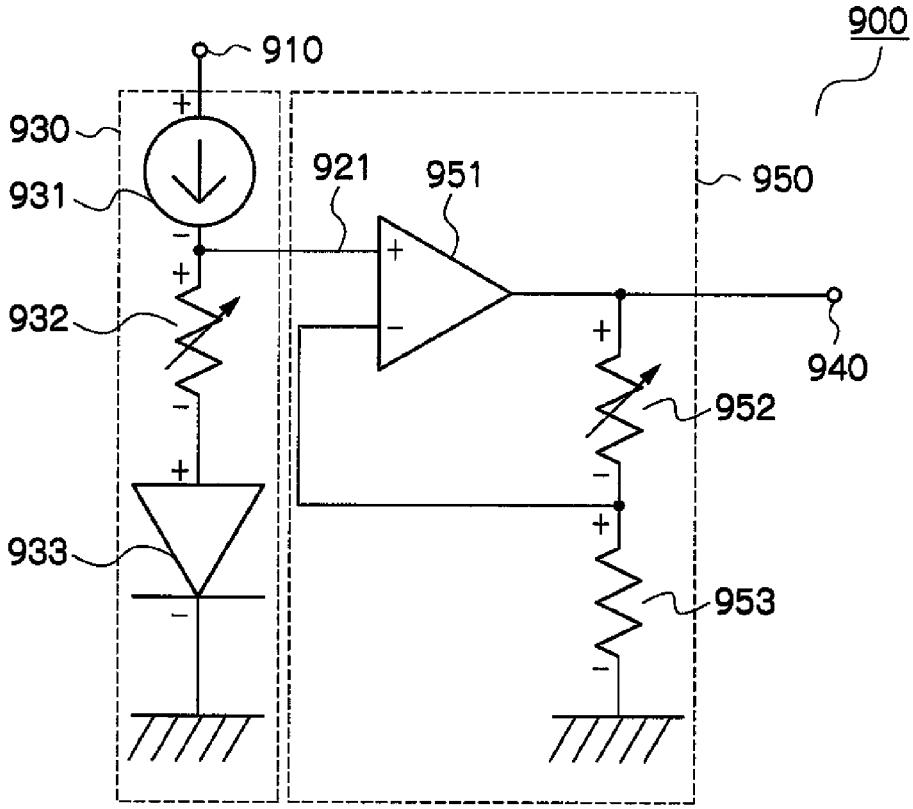
FIG.9A RELATED ART
FIG. 9A and FIG. 9B are drawings explaining a conventional regulator circuit and temperature gradients thereof.
Figure 9B:
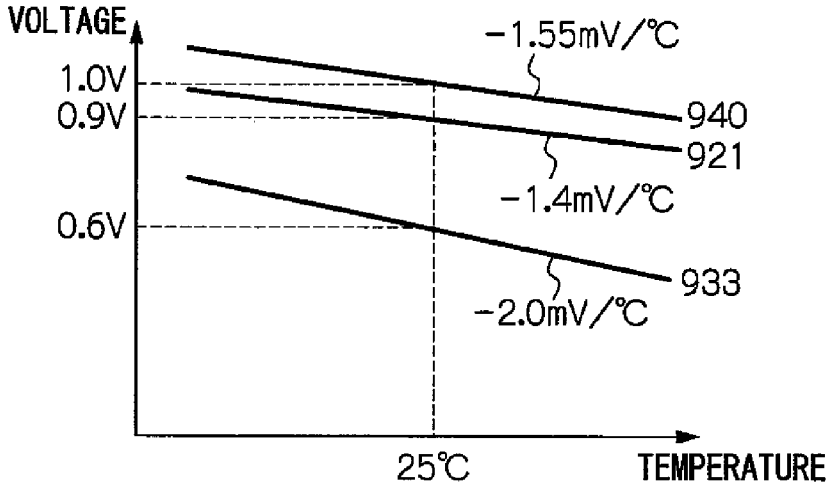
FIG.9B RELATED ART

As shown in FIG. 8, the amplifying unit 490 is formed from a third operational amplifier 491, a second variable resistor 492 whose resistance value is set to R44, and a third resistor 493 having resistance value R45. The positive terminal of the third operational amplifier 491 is, as described above, connected to the negative terminal of the second current source 471 of the second reference voltage outputting unit 470 and to the positive terminal of the first variable resistor 472. The negative terminal of the third operational amplifier 491 is connected to the negative terminal of the second variable resistor 492 and to the positive terminal of the third resistor 493. The output terminal of the third operational amplifier 491 is connected to the positive terminal of the second variable resistor 492 and outputs the output voltage 480 to an external circuit. The positive terminal of the second variable resistor 492 is, as described above, connected to the output terminal of the third operational amplifier 491 and to the external circuit. The negative terminal of the second variable resistor 492 is connected to the negative terminal of the third operational amplifier 491 and to the positive terminal of the third resistor 493. The positive terminal of the third resistor 493 is, as described above, connected to the negative terminal of the third operational amplifier 491 and to the negative terminal of the second variable resistor 492. The VSS potential which is the ground potential is supplied to the negative terminal of the third resistor 493.

Here, by using FIGS. 4A and 4B through FIG. 8, the operation of the regulator circuit 400 of the second exemplary embodiment will be described by using, as an example, a case in which the regulator circuit 400 outputs the output voltage 480 of 1.0 V at 25° C.

In the present exemplary embodiment, in the same way as the first exemplary embodiment, the rectifying element 432 is a diode. As the temperature characteristic of this diode, as shown in FIG. 4B, 0.6 V is output at 25° C., and the temperature gradient is −2.0 mV/° C.

The first reference voltage 421 which is output from the first reference voltage outputting unit 430 is equal to the voltage and the temperature gradient of the rectifying element 432. Accordingly, the first reference voltage 421 is 0.6 V and has a temperature gradient of −2.0 mV/° C.

The first reference voltage 421, which is 0.6 V and has a temperature gradient of −2.0 mV/° C., is input to the first operational amplifier 440. Because the first operational amplifier 440 functions as a voltage follower circuit, it outputs the second reference voltage 422 which is 0.6 V and whose temperature gradient is −2.0 mV/° C.

The second reference voltage 422, which is 0.6 V and whose temperature gradient is −2.0 mV/° C., is input to the voltage-dividing unit 450. The voltage-dividing unit 450 outputs, as the third reference voltage 423, a voltage corresponding to the first resistor 451 and the second resistor 452. Here, by making the ratio of the first resistor 451 and the second resistor 452 be 2:1 for example, the third reference voltage 423, which is 0.2 V and whose temperature gradient is 0.67 mV/° C., is output.

The third reference voltage 423, which is 0.2 V and whose temperature gradient is 0.67 mV/° C., is input to the second operational amplifier 460. Because the second operational amplifier 460 functions as a voltage follower circuit, it outputs the fourth reference voltage 424 which is 0.2 V and whose temperature gradient is −0.67 mV/° C.

The fourth reference voltage 424, which is 0.2 V and whose temperature gradient is −0.67 mV/° C., is input to the second reference voltage outputting unit 470. The fifth reference voltage 425, which adds the potential difference between the second current source 471 and the first variable resistor 472, is output. At this time, the temperature gradient of the fifth reference voltage 425 is a value equal to the sum of the temperature gradient of the first variable resistor 472 and the temperature gradient of the fourth reference voltage 424. Because the first variable resistor 472 has a positive voltage gradient, the higher the ratio of the voltage of the first variable resistor 472 with respect to the voltage of the fourth reference voltage 424, the more the value of the temperature gradient of the fifth reference voltage 425 is regulated toward the positive direction. Namely, if the resistance value R43 of the first variable resistor 472 is made to be large, the value of the temperature gradient of the fifth reference voltage 425 can be controlled toward the positive direction. In this example, the first variable resistor 472 is set to be 0.7 V at 25° C., and has a temperature gradient of 1.4 mV/° C. Accordingly, at 25° C., the fifth reference voltage 425 becomes 0.9 V and has a temperature gradient of 0.73 mV/° C.

The amplifying unit 490 is a non-inverting amplifying circuit structured from the third operational amplifier 491, the second variable resistor 492, and the third resistor 493. Because the fifth reference voltage 425 is 0.9 V, by making it be 10/9 times, the output voltage 480 of 1.0 V is obtained. At this time, by making the ratio of the resistance values of the second variable resistor 491 and the third resistor 493 be 1:9, the output voltage 480 of 1.0 V is obtained. Here, the temperature gradient of the fifth reference voltage 425 as well is amplified 10/9 times and becomes 0.81 mV/° C. In this way, the amplifying unit 490 outputs the output voltage 480 which is 1.0 V and whose temperature gradient is 0.81 mV/° C.

The regulator circuit of the second exemplary embodiment of the present invention has the first reference voltage outputting unit 430, the first operational amplifier 440, the voltage-dividing unit 450, the second operational amplifier 460, the second reference voltage outputting unit 470, and the amplifying unit 490. In this way, the requisite power source voltage 480 can be output, and a positive temperature gradient can be obtained. Further, in accordance with the regulator circuit of the second exemplary embodiment of the present invention, in the same way as in the first exemplary embodiment, the consumed current can be suppressed to several hundred nA. Moreover, in a conventional regulator circuit, if the temperature gradient is fixed, the voltage output at a given temperature is fixed singly. However, in the second exemplary embodiment of the present invention, by changing the resistance ratio of the first resistor 451 and the second resistor 452, the temperature gradient at a given voltage can be provided with degrees of freedom. In addition, because the temperature gradient can be provided with degrees of freedom by changing the resistance ratio of the first resistor 451 and the second resistor 452, designing of the in-phase input ranges of the second operational amplifier 460 and the third operational amplifier 490 within the regulator can be carried out easily.

Exemplary embodiments of the present invention are described above, but the present invention is not limited to these exemplary embodiments as will be clear to those skilled in the art.

A regulator circuit of a first aspect of the present invention has: a reference voltage outputting unit which is connected to a power source voltage, and which has a rectifying element, and which outputs a first reference voltage; a first operational amplifier to which the first reference voltage is input, and which outputs a second reference voltage equal to the first reference voltage; a voltage-dividing unit to which the second reference voltage is input, and which outputs a third reference voltage having a voltage lower than the second reference voltage; and a second operational amplifier to which the third reference voltage is input, and which outputs an output voltage equal to the third reference voltage.

A regulator circuit of a second aspect of the present invention has: a first reference voltage outputting unit which is connected to a first power source voltage, and which has a rectifying element, and which outputs a first reference voltage; a first operational amplifier to which the first reference voltage is input, and which outputs a second reference voltage equal to the first reference voltage; a voltage-dividing unit to which the second reference voltage is input, and which outputs a third reference voltage having a voltage lower than the second reference voltage; a second operational amplifier to which the third reference voltage is input, and which outputs a fourth reference voltage equal to the third reference voltage; a second reference voltage outputting unit which is connected to a second power source voltage, and to which the fourth reference voltage is input, and which outputs a fifth reference voltage; and an amplifying unit to which the fifth reference voltage is input, and which outputs an output voltage having a voltage which is greater than the fifth reference voltage.

In accordance with the above-described structures, the output voltage of the regulator circuit can be set without depending upon the voltage of the rectifying element, and the temperature gradient of the output voltage can be regulated fixer in the positive direction.

What is claimed is:

1. A regulator circuit comprising:

a reference voltage outputting unit to which a power source voltage is applied, and which has a rectifying element, and which outputs a first reference voltage;

a first operational amplifier to which the first reference voltage is input, and which outputs a second reference voltage having a voltage equal to the first reference voltage;

a voltage-dividing unit to which the second reference voltage is input, and which outputs a third reference voltage having a voltage lower than the second reference voltage; and a second operational amplifier to which the third reference voltage is input, and which outputs an output voltage having a voltage equal to the third reference voltage.

2. The regulator circuit of claim 1, wherein the reference voltage outputting unit comprises:

a current source to which the power source voltage is applied, and which supplies a first current;

a first variable resistor connected to the current source; and the rectifying element which is connected to the first variable resistor and a first ground potential, wherein the reference voltage outputting unit outputs, as the first reference voltage, a potential between the current source and the first variable resistor.

3. The regulator circuit of claim 1, wherein the voltage-dividing unit comprises:

a second variable resistor to which the second reference voltage is input; and a first fixed resistor connected to the second variable resistor and a second ground potential, wherein the voltage-dividing unit outputs, as the third reference potential, a potential between the second variable resistor and the first fixed resistor.

4. A regulator circuit comprising:

a first reference voltage outputting unit to which a first power source voltage is applied, and which has a rectifying element, and which outputs a first reference voltage;

a first operational amplifier to which the first reference voltage is input, and which outputs a second reference voltage having a voltage equal to the first reference voltage;

a voltage-dividing unit to which the second reference voltage is input, and which outputs a third reference voltage having a voltage lower than the second reference voltage;

a second operational amplifier to which the third reference voltage is input, and which outputs a fourth reference voltage having a voltage equal to the third reference voltage;

a second reference voltage outputting unit to which a second power source voltage is applied, and to which the fourth reference voltage is input, and which outputs a fifth reference voltage; and an amplifying unit to which the fifth reference voltage is input, and which outputs an output voltage having a voltage greater than the fifth reference voltage.

5. The regulator circuit of claim 4, wherein the first reference voltage outputting unit comprises:

a first current source to which the first power source voltage is applied, and which supplies a first current; and the rectifying element connected to the first current source and a first ground potential, wherein the first reference voltage outputting unit outputs, as the first reference voltage, a potential between the first current source and the rectifying element.

6. The regulator circuit of claim 4, wherein the voltage-dividing unit comprises:

a first fixed resistor to which the second reference voltage is input; and a second fixed resistor connected to the first fixed resistor and a second ground potential, wherein the voltage-dividing unit outputs, as the third reference potential, a potential between the first fixed resistor and the second fixed resistor.

7. The regulator circuit of claim 4, wherein the second reference voltage outputting unit comprises:

a second current source to which the second power source voltage is applied, and which supplies a second current; and a first variable resistor which is connected to the second current source and to which the fourth reference voltage is input, wherein the second reference voltage outputting unit outputs, as the fifth reference voltage, a potential between the second current source and the first variable resistor.

8. The regulator circuit of claim 4, wherein the amplifying unit comprises a third operational amplifier comprising:

a first terminal to which the fifth reference voltage is input;

a second terminal connected to a third ground potential via a third fixed resistor; and an output terminal connected to the third fixed resistor via a second variable resistor, and which outputs the output voltage.

* * * * *